US009755366B2

(12) United States Patent
Kanda et al.

(10) Patent No.: US 9,755,366 B2
(45) Date of Patent: Sep. 5, 2017

(54) LOCK STRUCTURE OF CONNECTOR

(71) Applicant: YAZAKI CORPORATION, Tokyo (JP)

(72) Inventors: Hidenori Kanda, Makinohara (JP); Takuya Hasegawa, Fujieda (JP); Nobuyuki Mukoujima, Fujieda (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 14/994,276

(22) Filed: Jan. 13, 2016

(65) Prior Publication Data

US 2016/0204551 A1 Jul. 14, 2016

(30) Foreign Application Priority Data

Jan. 14, 2015 (JP) ..... 2015-005242

(51) Int. Cl.

| | |
|---|---|
| ***H01R 13/62*** | (2006.01) |
| ***H01R 13/639*** | (2006.01) |
| ***H01R 13/627*** | (2006.01) |
| ***H01R 13/633*** | (2006.01) |

(52) U.S. Cl.

CPC ..... *H01R 13/639* (2013.01); *H01R 13/6272* (2013.01); *H01R 13/633* (2013.01)

(58) Field of Classification Search

CPC ..... H01R 13/6271; H01R 13/6272; H01R 13/6273; H01R 12/774

USPC ..... 439/350, 353, 354, 357, 358, 372; 403/322.4

See application file for complete search history.

(56) References Cited

U.S. PATENT DOCUMENTS

| | | | | |
|---|---|---|---|---|
| 4,272,145 | A * | 6/1981 | LaDuke | H01R 13/6272 439/358 |
| 4,273,403 | A * | 6/1981 | Cairns | H01R 13/6272 285/921 |
| 6,669,398 | B2 * | 12/2003 | Wada | C08J 9/0004 403/322.4 |
| 7,056,142 | B2 * | 6/2006 | Ueda | H01R 13/6272 439/328 |
| 2004/0166717 | A1 | 8/2004 | Muro et al. | |

(Continued)

FOREIGN PATENT DOCUMENTS

| | | | |
|---|---|---|---|
| JP | 02-054180 | U | 4/1990 |
| JP | 2004-259600 | A | 9/2004 |
| JP | 2013-058358 | A | 3/2013 |

OTHER PUBLICATIONS

Communication dated Dec. 13, 2016, issued by the Japanese Patent Office in counterpart Japanese application No. 2015-005242.

(Continued)

*Primary Examiner* — Vanessa Girardi
(74) *Attorney, Agent, or Firm* — Sughrue Mion, PLLC

(57) ABSTRACT

A lock structure of a connector includes a lock arm and a lock release arm which are provided in one connector housing of a pair of connector housings which are fitted into each other. The lock arm is engaged with a lock engagement part of the other connector housing to lock a fitting state between the connector housings when fitting between the connector housings is completed. The lock release arm is formed integrally with the lock arm and can deflect the lock arm in a lock release direction. The lock release arm is provided above the lock arm.

6 Claims, 13 Drawing Sheets

(56) References Cited

U.S. PATENT DOCUMENTS

2014/0179146 A1 6/2014 Hamai et al.

OTHER PUBLICATIONS

Office Action dated Apr. 11, 2017 issued by the Japanese Patent Office in counterpart Japanese Patent Application No. 2015-005242.

* cited by examiner

LOCK STRUCTURE OF CONNECTOR

CROSS-REFERENCE TO RELATED APPLICATION(S)

This application is based upon and claims the benefit of priority from prior Japanese patent application No. 2015-005242, filed on Jan. 14, 2015, the entire contents of which are incorporated herein by reference.

BACKGROUND

1. Technical Field

The present invention relates to a lock structure of a connector.

2. Background Art

FIGS. 10 to 13 show a lock structure of a connector disclosed in JP-A-2013-58358.

The lock structure is a structure which can lock a fitting state between connector housings of a connector 100 when fitting between the connector housings is completed, and which can release a lock state between the connector housings in order to detach the locked connector housings from each other. The connector 100 includes a pair of the connector housings, i.e. a first connector housing 110 and a second connector housing 120.

In the case of the lock structure in JP-A-2013-58358, the first connector housing 110 which is one connector housing is provided with a lock portion 113. The lock portion 113 has a lock arm 111 and lock release arms 112. In addition, as shown in FIG. 12, the second connector housing 120 which is the other connector housing is provided with a lock engagement part 121 engaged with the lock arm 111 when fitting between the connector housings is completed.

As shown in FIGS. 11 and 12, the lock arm 111 in the lock portion 113 is provided with a pair of flexible arms 111*a*, a connection part 111*b* and a lock protrusion 111*c*. Each of the flexible arms 111*a* extends from a place closer to a rear end of a housing body 114 of the first connector housing 110 toward a front end of the housing body 114. The connection part 111*b* connects distal end portions of the pair of flexible arms 111*a* to each other. The lock protrusion 111*c* is protrusively provided in a lower portion of the connection part 111*b*.

As shown in FIG. 10, the housing body 114 of the first connector housing 110 is a part which has terminal receiving holes 114*a* receiving terminal metal fittings. The first connector housing 110 has a hood portion 115 which is substantially shaped like a cylinder and which covers an outer circumference of the housing body 114. The hood portion 115 defines, around the housing body 114, a housing fitting space 116 into which a distal end cylindrical portion 122 of the second connector housing 120 is fitted. The aforementioned lock engagement part 121 is a protrusion which is protrusively provided in an outer circumferential surface of the distal end cylindrical portion 122.

As shown in FIG. 12, each of the flexible arms 111*a* of the lock arm 111 is provided with a base end portion 111*d* and a spring piece portion 111*e*. The base end portion 111*d* rises up from an outer circumferential surface closer to the rear end of the housing body 114. The spring piece portion 111*e* extends from a distal end of the base end portion 111*d* toward the front end side of the housing body 114.

A distal end side (front end side) of the spring piece portion 111*e* can be deflected in a height direction (a direction of arrow Y1 in FIG. 12) of the first connector housing 110. In addition, the pair of flexible arms 111*a* are provided separately from each other in a width direction (a direction of an arrow X1 in FIG. 10) of the first connector housing 110.

The lock protrusion 111*c* of the lock arm 111 is a protrusion which protrudes toward the surface of the housing body 114 from the connection part 111*b* connecting the distal end portions of the pair of flexible arms 111*a* to each other. When fitting between the connector housings is completed, the lock protrusion 111*c* is engaged with the lock engagement part 121 of the second connector housing 120 as shown in FIG. 13. In this manner, the connector housings are restricted from moving in a detachment direction from each other. Thus, the fitting state between the connector housings is locked.

As shown in FIG. 12, the lock protrusion 111*c* of the lock arm 111 rides onto the lock engagement part 121 due to elastic deformation of the flexible arms 111*a* when the connector housings are being fitted into each other. In addition, when the fitting between the connector housings is completed, the lock protrusion 111*c* climbs over the lock engagement part 121 to move down to the back of the lock engagement part 121 due to elastic restoring force of the flexible arms 11*a*. Thus, the lock protrusion 111*c* is engaged with the lock engagement part 121.

As shown in FIG. 11, the lock release arms 112 of the lock portion 113 are provided to be paired and located outside the lock arm 111 in the width direction of the first connector housing 110. Each of the lock release arms 112 is provided with a release arm body 112*a* and a fulcrum portion 112*b*. The release arm body 112*a* extends from an end portion of the connection part 111*b* toward a rear end side of the first connector housing 110. The fulcrum portion 112*b* is provided in a lower part of a longitudinally intermediate portion of the release arm body 112*a*. In addition, free ends of the release arm bodies 112*a* located on the rear end side of the first connector housing 110 are connected to each other by an operating portion 112*c*.

When the operating portion 112*c* is pushed down in a direction of an arrow Y2 as shown in FIG. 12, the free end sides of the pair of lock release arms 112 move down toward the housing body 114 side. When the fulcrum portions 112*b* abut against the outside surface of the housing body 114 as shown in FIG. 12, the lock release arms 112 swing with the fulcrum portions 112*b* as fulcrums. Due to the swing, the lock protrusion 111*c* is displaced in a lock release direction (a direction of an arrow Y3 in FIG. 12).

That is, the lock release arms 112 are swung around the fulcrum portions 112*b* so that the lock state carried out by the lock arm 111 can be released.

Incidentally, the lock protrusion 111*c* of the lock arm 111 rides onto the lock engagement part 121 when the connector housings are being fitted into each other. On this occasion, the lock release arms 112 provided integrally with the connection part 111*b* are also displaced due to deflection displacement of the flexible arms 111*a*. The operating portion 112*c* moves down toward the housing body 114 side even in such a situation.

In the lock structure disclosed in JP-A-2013-58358, the lock release arms 112 of the lock portion 113 are disposed outside the lock arm 111 in the width direction, as shown also in FIG. 10.

For this reason, the width of the lock structure is larger than the width of the lock arm 111. Therefore, there is a problem that the size of the first connector housing 110 may be increased due to the increase of the width of the lock structure.

SUMMARY

The present invention may provide a lock structure of a connector in which it is possible to prevent the width of the lock structure from increasing due to a lock release arm and it is therefore possible to reduce the width of a connector housing.

The lock structure may comprise: a lock arm and a lock release arm which are provided in one connector housing of a pair of connector housings which are fitted into each other, the lock arm which is engaged with a lock engagement part of the other connector housing to lock a fitting state between the connector housings when fitting between the connector housings is completed, the lock release arm which is formed integrally with the lock arm and which can deflect the lock arm in a lock release direction, and the lock release arm may be provided above the lock arm.

An upper surface portion of a distal end portion of the lock release arm may be formed with a taper portion in which thickness of the lock release arm is reduced gradually toward a distal end of the lock release arm.

DETAILED DESCRIPTION OF EXEMPLARY EMBODIMENTS

A preferred embodiment of a lock structure of a connector according to the invention will be described below in detail with reference to the drawings.

Figure 1:
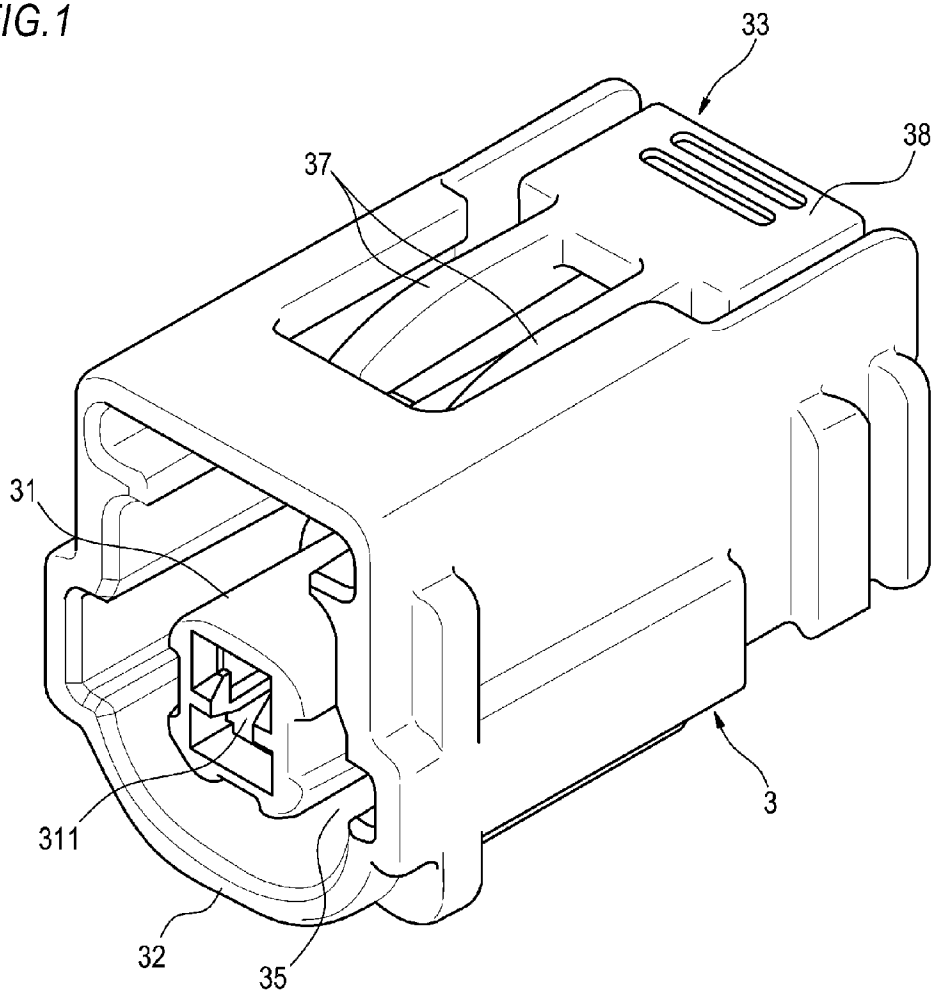
FIG. 1 is a perspective view of an embodiment of one connector housing having a lock structure of a connector according to the invention.
Figure 2:
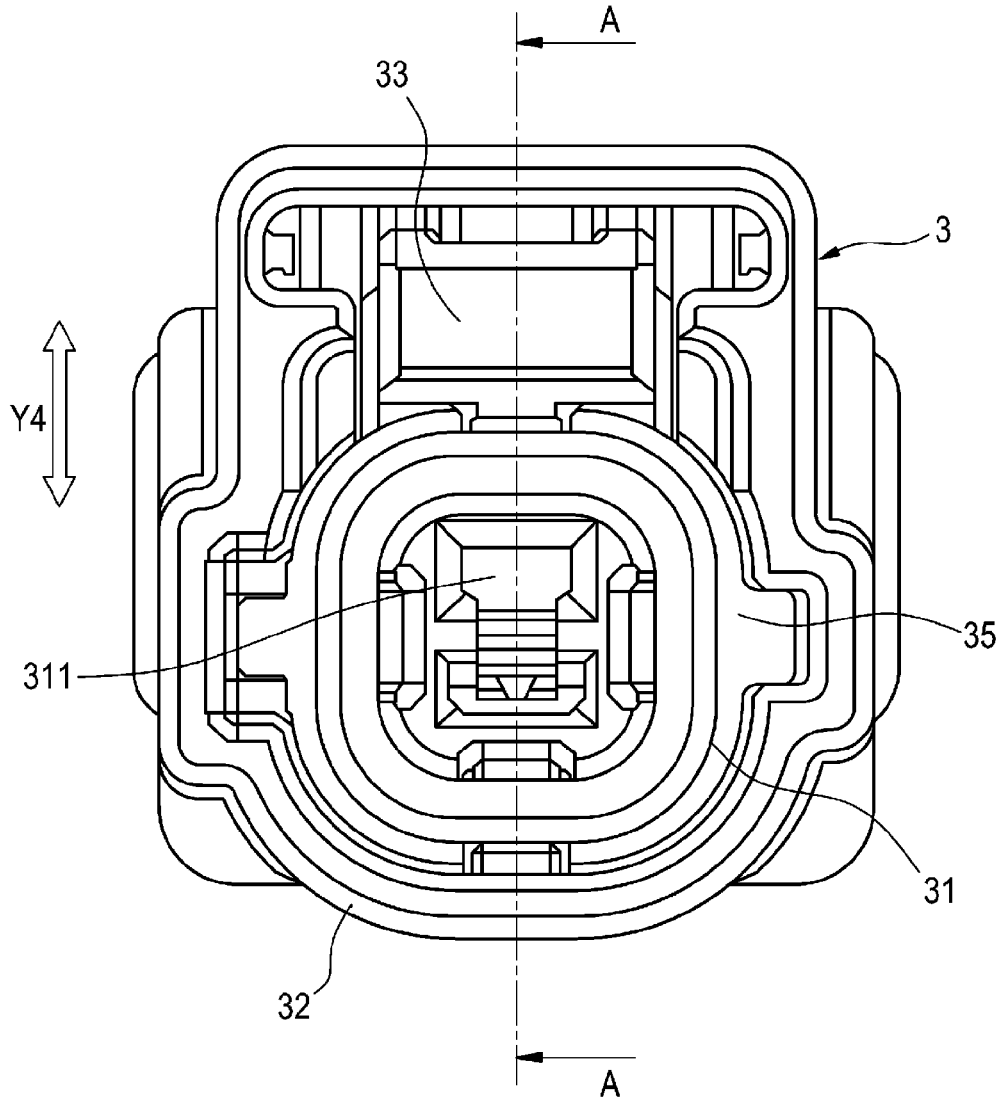
FIG. 2 is a front view of the connector housing shown in FIG. 1.
Figure 3:
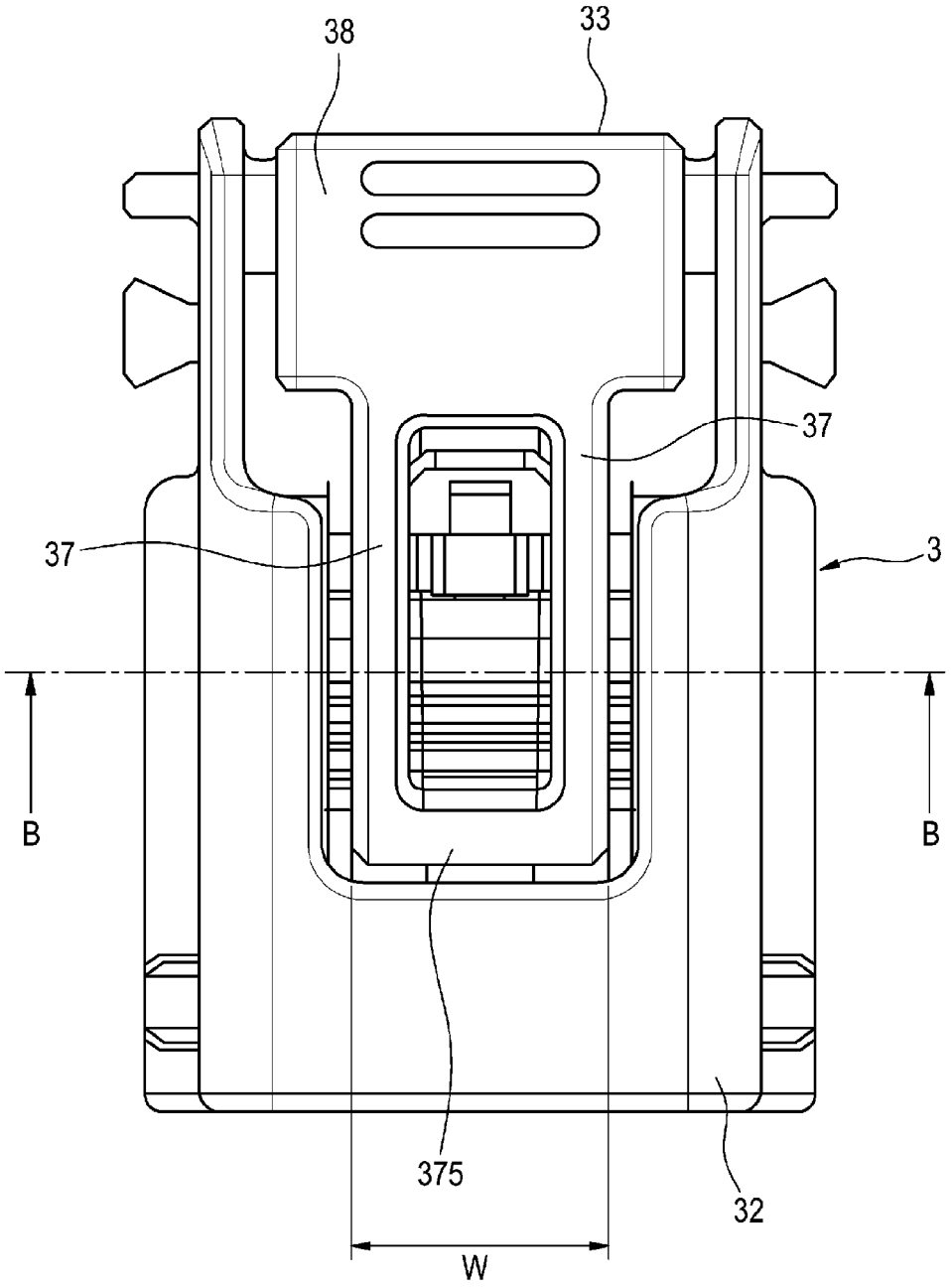
FIG. 3 is a plan view of the connector housing shown in FIG. 1.
Figure 4:
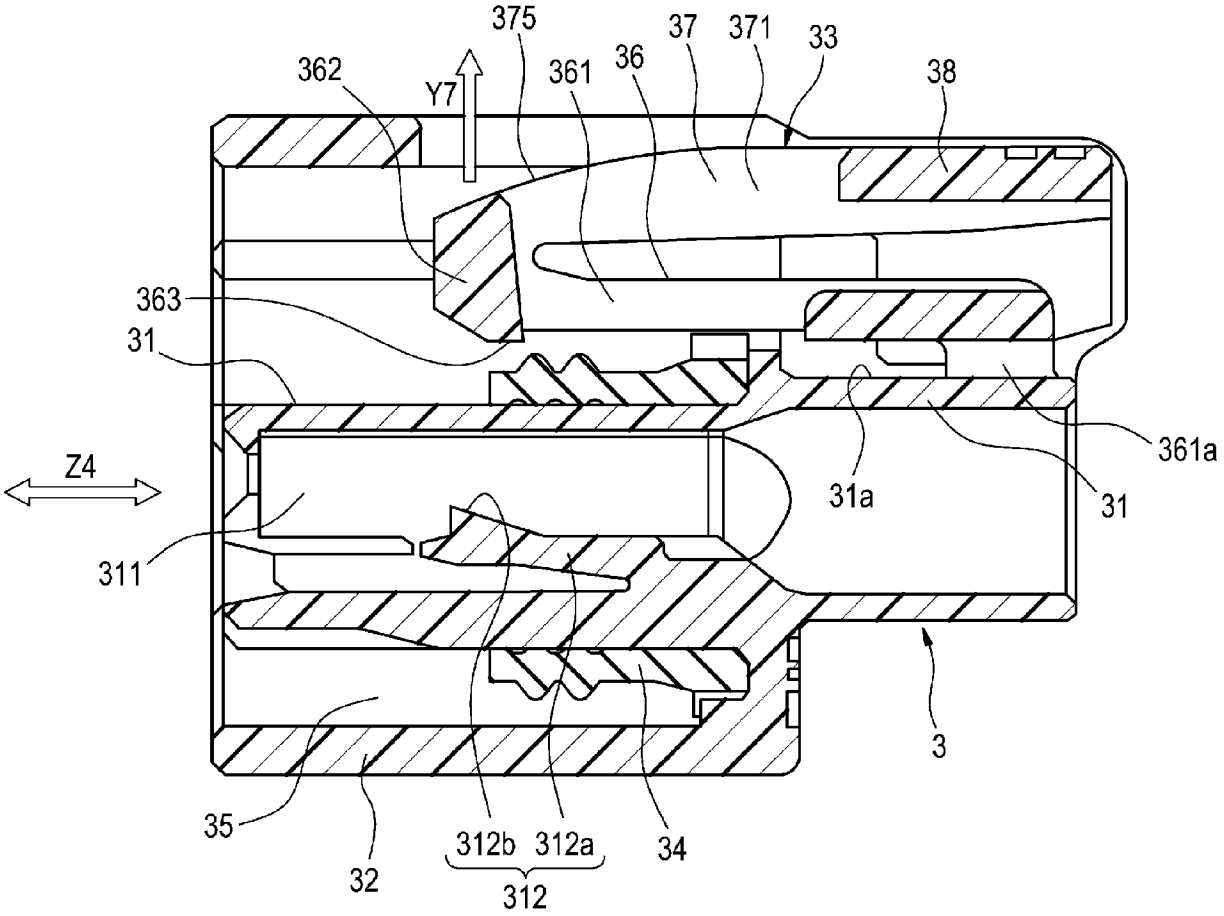
FIG. 4 is a sectional view taken along a line A-A of FIG. 2.
Figure 5:
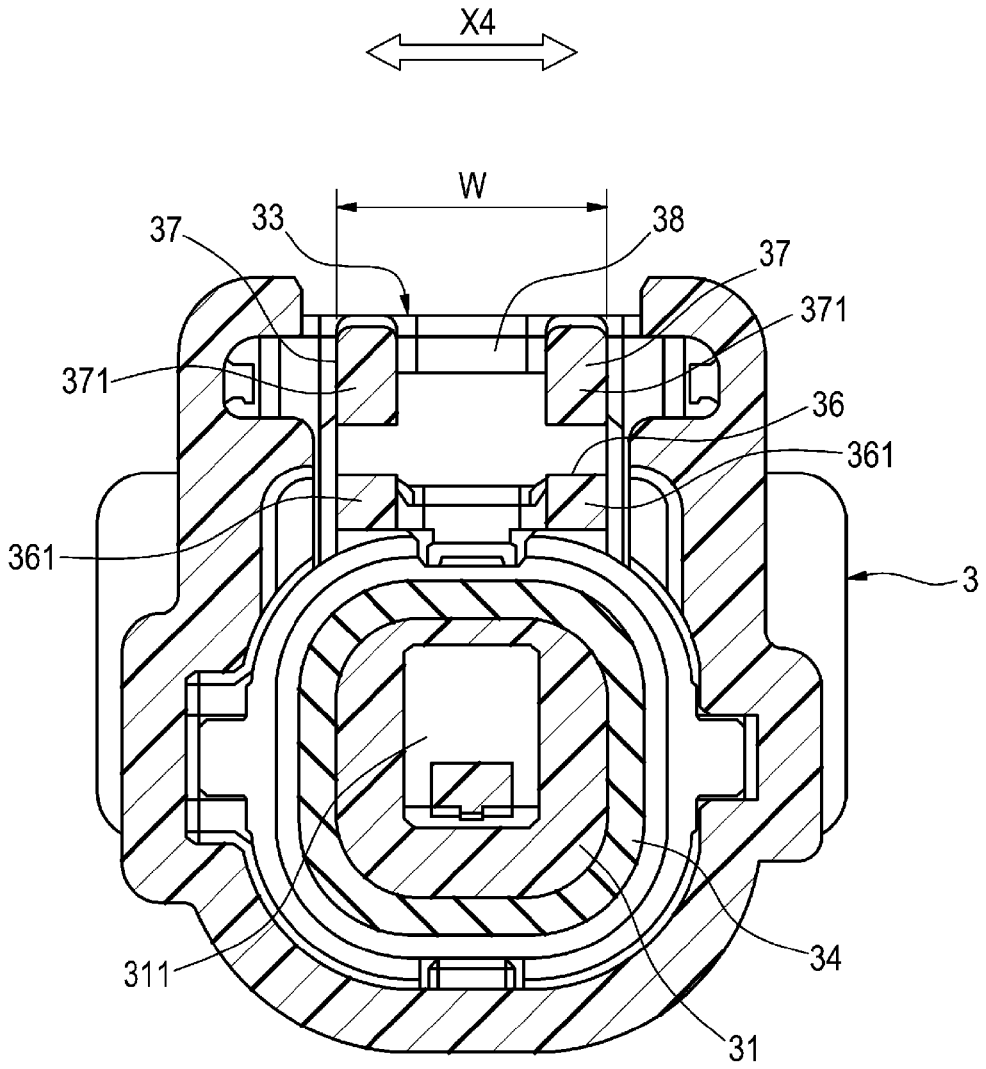
FIG. 5 is a sectional view taken along a line B-B of FIG. 3.
Figure 6:
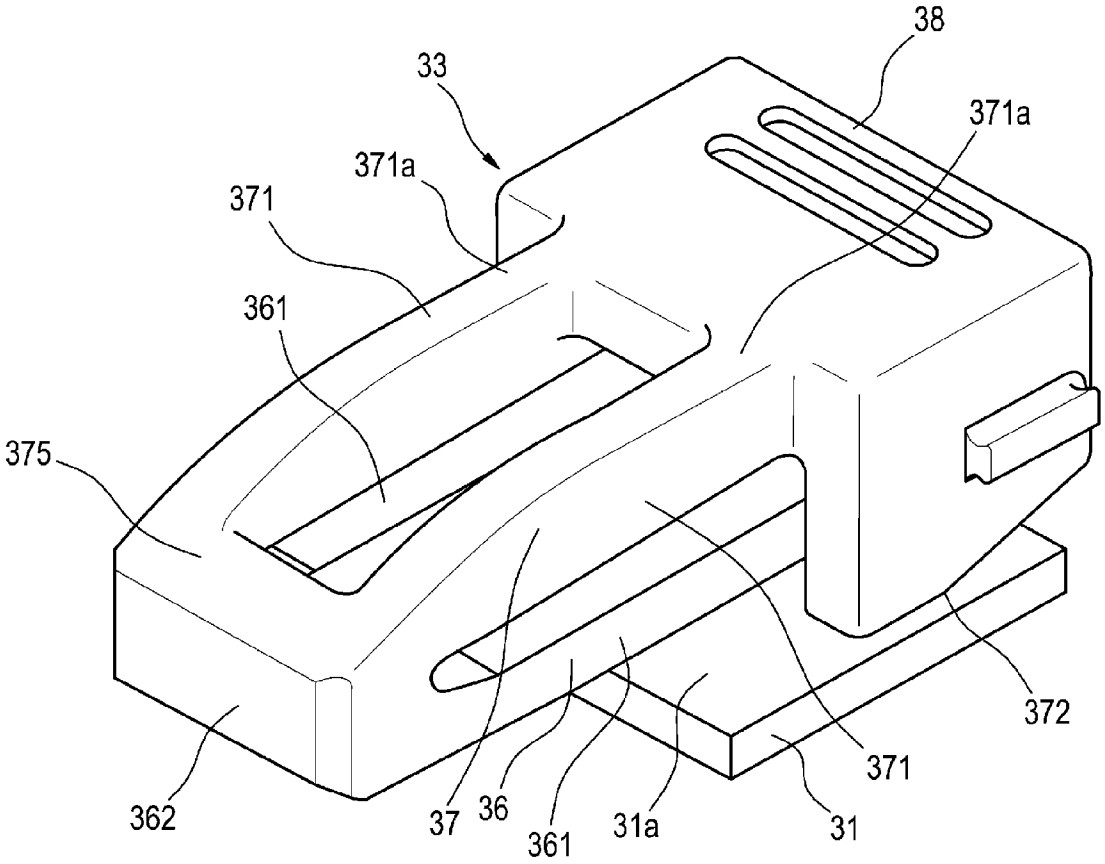
FIG. 6 is an enlarged perspective view of a lock portion of the connector housing shown in FIG. 1.
Figure 7:
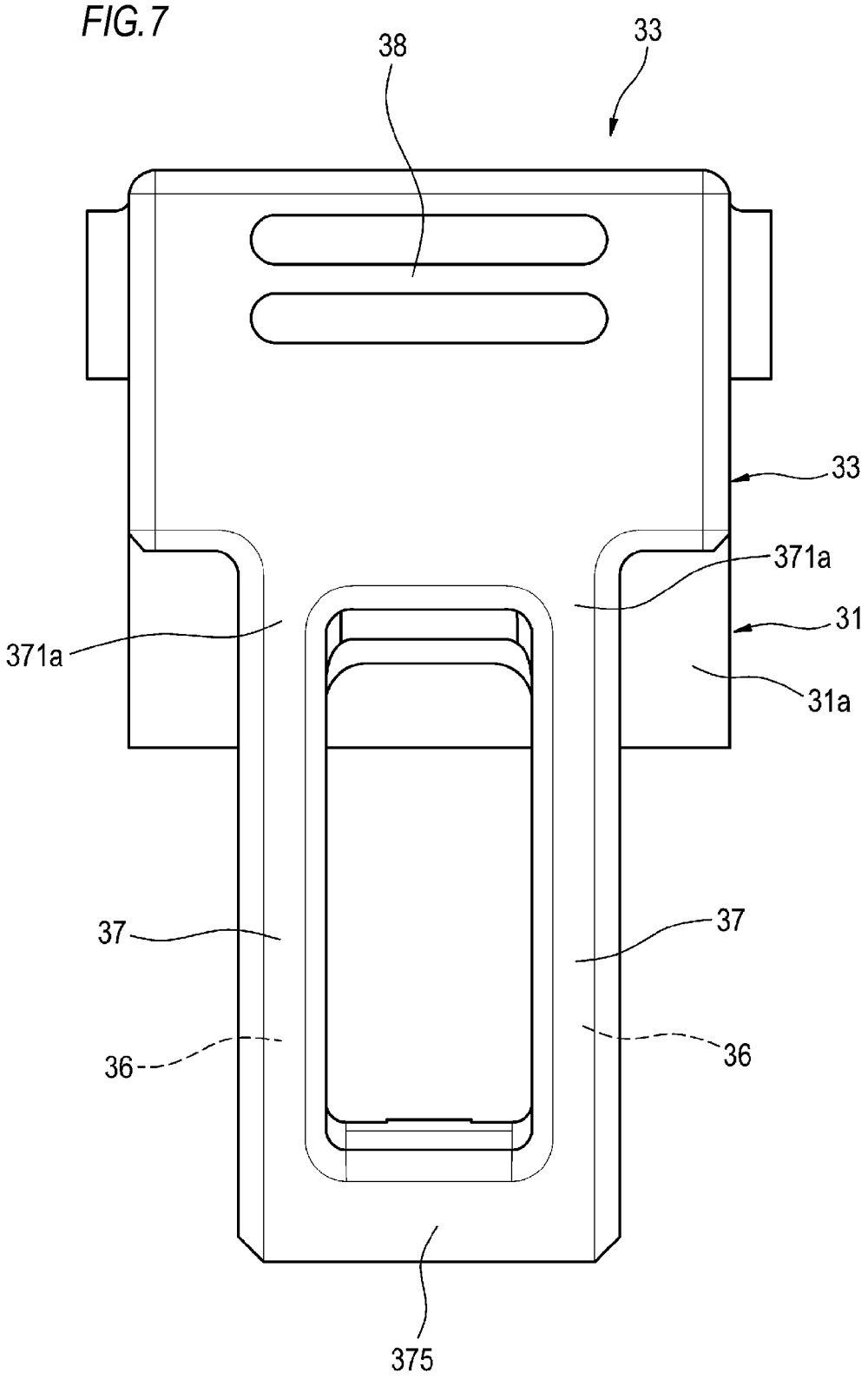
FIG. 7 is a plan view of the lock portion shown in FIG. 6.
Figure 8:
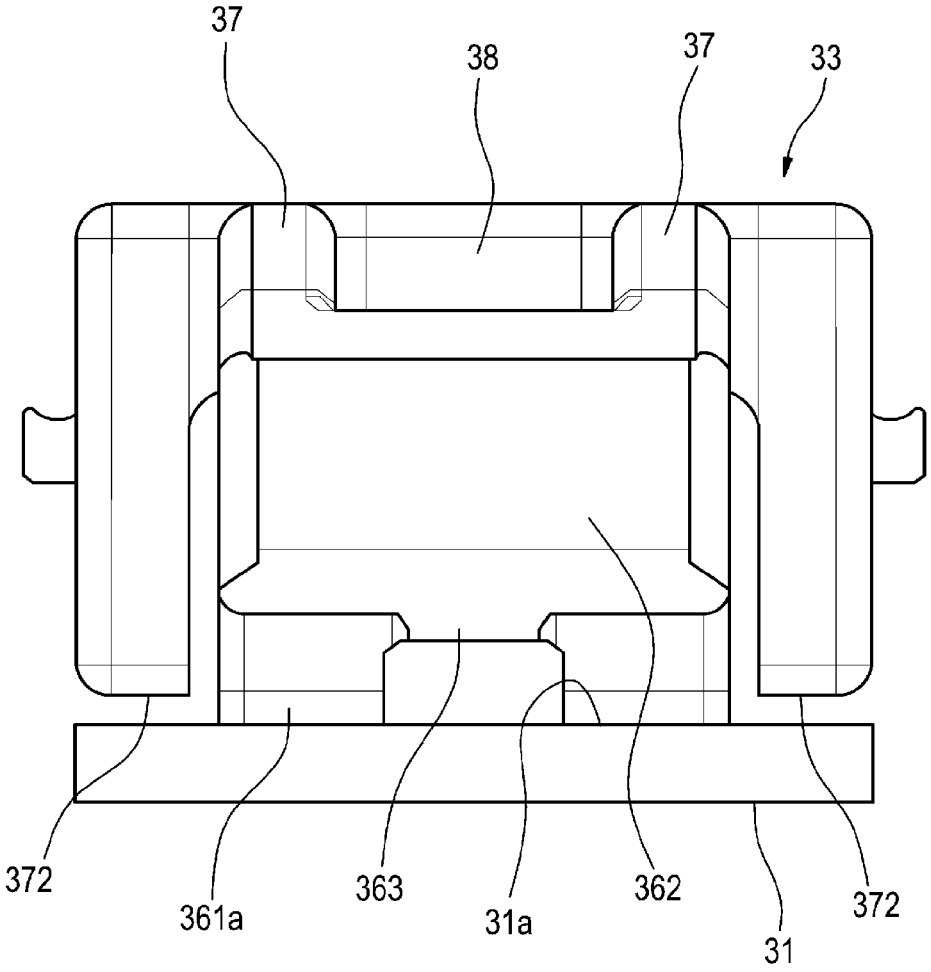
FIG. 8 is a front view of the lock portion shown in FIG. 6.
Figure 9:
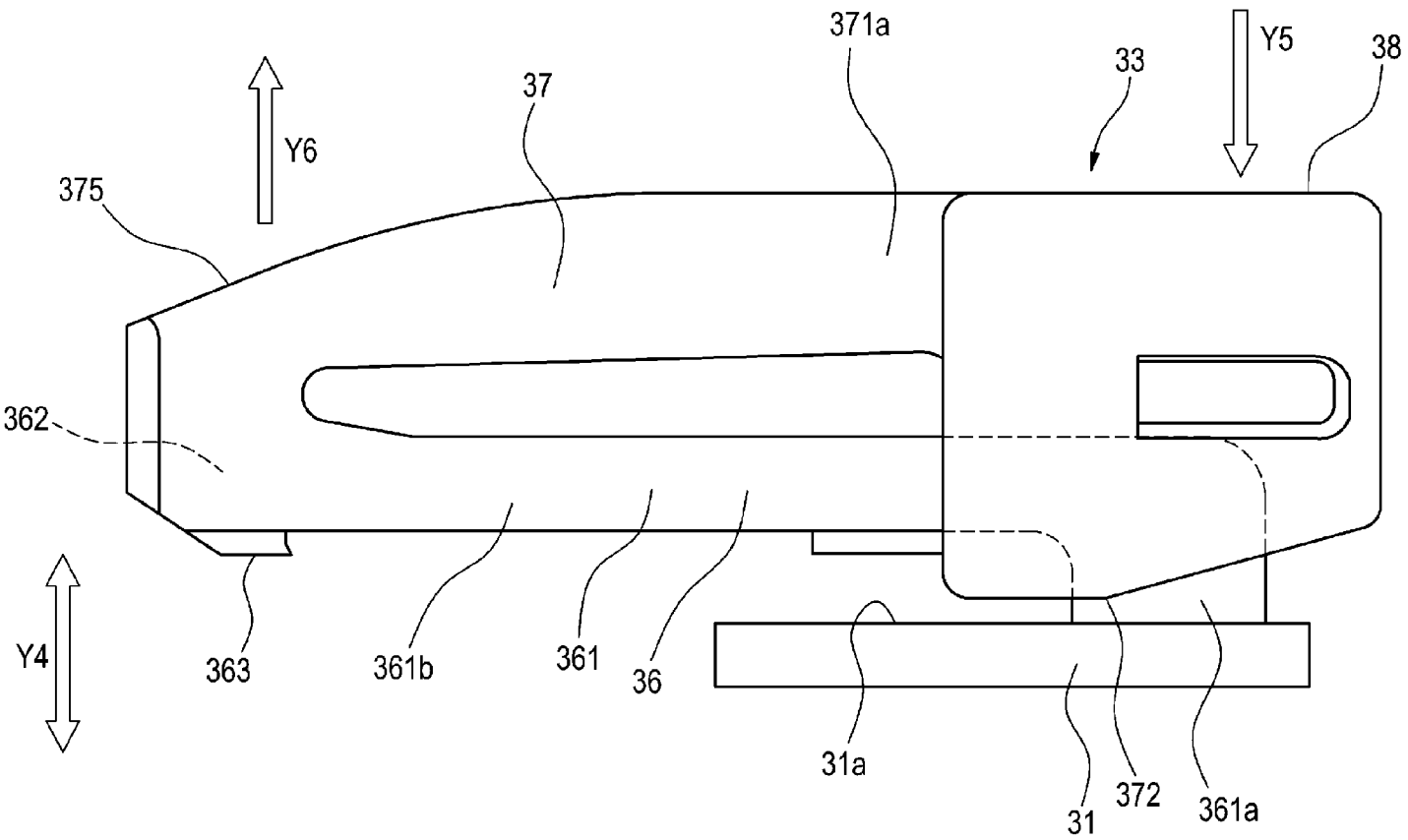
FIG. 9 is a side view of the lock portion shown in FIG. 6.
Figure 10:
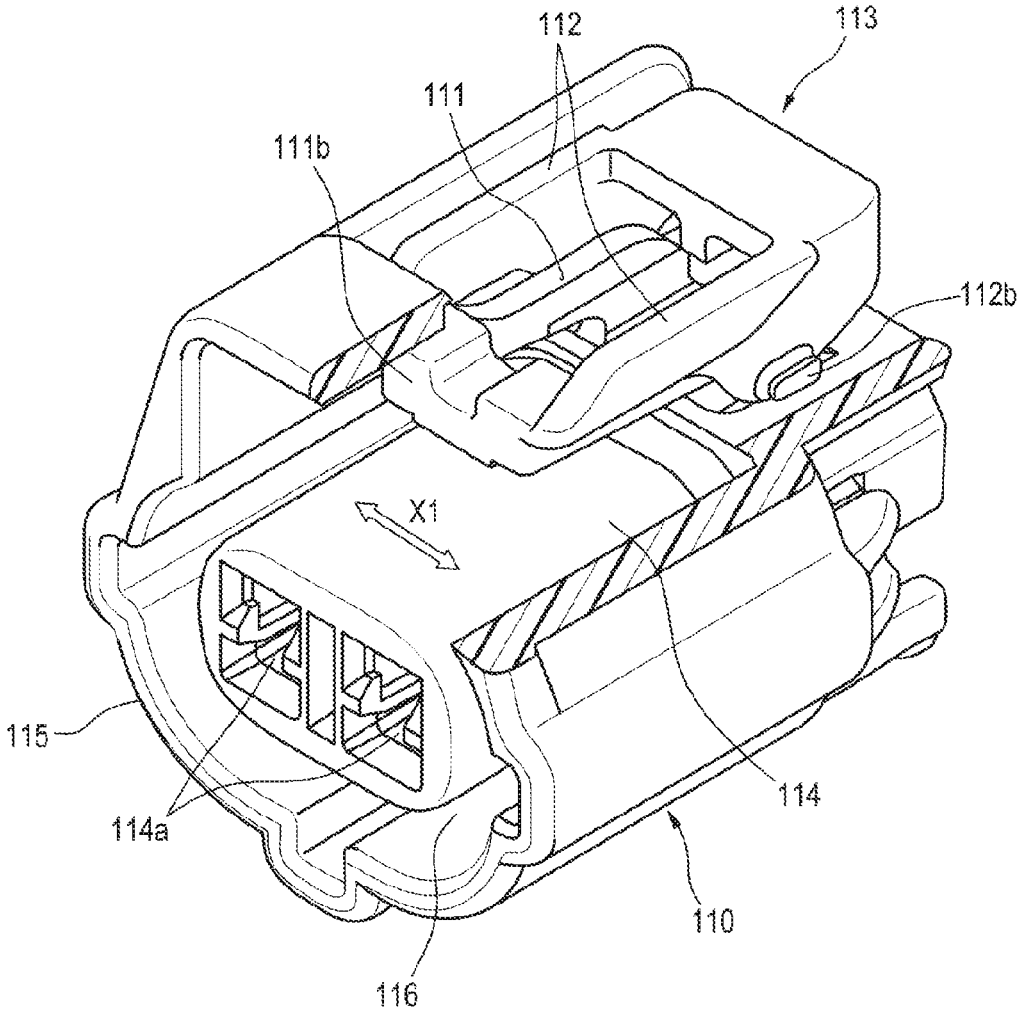
FIG. 10 PRIOR ART
FIG. 10 is a perspective view of one connector housing of a pair of connector housings having a lock structure of a connector according to the background art.
Figure 11:
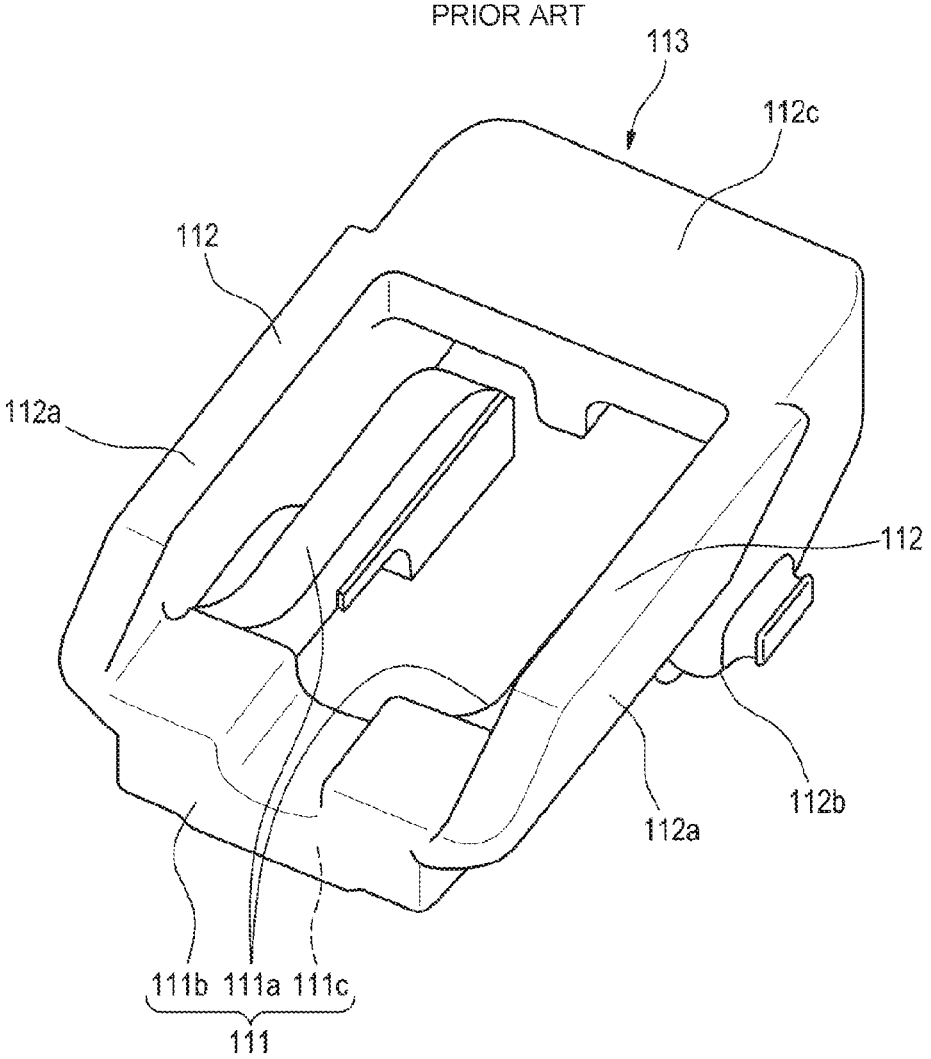
FIG.11 PRIOR ART
FIG. 11 is an enlarged view of a lock portion shown in FIG. 10.

FIGS. 1 to 9 show an embodiment of the lock structure of the connector according to the invention. FIG. 1 is a perspective view of an embodiment of one connector housing having the lock structure of the connector according to the invention. FIG. 2 is a front view of the connector housing shown in FIG. 1. FIG. 3 is a plan view of the connector housing shown in FIG. 1. FIG. 4 is a sectional view taken along a line A-A of FIG. 2. FIG. 5 is a sectional view taken along a line B-B of FIG. 3. FIG. 6 is an enlarged perspective view of a lock portion of the connector housing shown in FIG. 1. FIG. 7 is a plan view of the lock portion shown in FIG. 6. FIG. 8 is a front view of the lock portion shown in FIG. 6. FIG. 9 is a side view of the lock portion shown in FIG. 6.

A connector housing 3 shown in FIG. 1 is one connector housing of a pair of connector housings connected to each other by the lock structure according to the embodiment of the invention.

The connector housing 3 is provided with a terminal receiving portion 31, a hood portion 32, and a lock portion 33. The terminal receiving portion 31 receives a terminal metal fitting. The hood portion 32 which is substantially shaped like a cylinder surrounds an outer circumference of the terminal receiving portion 31. The lock portion 33 is provided in an outside surface of an upper portion of the terminal receiving portion 31.

The connector housing 3 is a single-pole connector housing which can receive one terminal metal fitting.

As shown in FIG. 4, the terminal receiving portion 31 of the connector housing 3 is provided with a terminal receiving hole 311 and a terminal lock lance 312. A not-shown terminal metal fitting is received in the terminal receiving hole 311. The terminal lock lance 312 is disposed to face the terminal receiving hole 311.

As shown in FIG. 4, the terminal receiving hole 311 is formed in a central portion of the terminal receiving portion 31 to penetrate in a direction (a direction of an arrow Z4 in FIG. 4) in which the connector housings are fitted into each other.

The terminal lock lance 312 has a flexible piece 312*a* and a lock protrusion 312*b*. The flexible piece 312*a* extends in a length direction of the terminal receiving hole 311. The lock protrusion 312*b* protrudes into the terminal receiving hole 311 from the flexible piece 312*a*. As soon as the terminal metal fitting inserted into the terminal receiving hole 311 reaches a prescribed position of the terminal lock lance 312, the lock protrusion 312*b* is engaged with the terminal metal fitting to thereby prevent the terminal metal fitting from coming off.

As shown in FIG. 4, a cylindrical seal member 34 is fitted and mounted onto an outer circumference of the terminal receiving portion 31 in the connector housing 3 in the embodiment. The seal member 34 is held between a cylindrical portion of a mating connector housing (not shown) fitted onto the outer circumference of the terminal receiving portion 31 and the terminal receiving portion 31. In this manner, waterproofness between the connector housings can be secured.

The hood portion 32 has a substantially cylindrical structure which surrounds the outer circumference of the terminal receiving portion 31. A housing fitting space 35 into which the cylindrical portion of the mating connector housing (not shown) is fitted is defined between the hood portion 32 and the terminal receiving portion 31.

The lock portion 33 has a structure serving as the lock structure according to the invention. As shown in FIGS. 1 to 5, the lock portion 33 is provided with a lock arm 36, lock release arms 37, and an operating portion 38.

As shown in FIGS. 4 to 6, the lock arm 36 is provided with a pair of flexible arms 361, a connection part 362 and a lock protrusion 363. The pair of flexible arms 361 extend from an outside surface 31*a* of a place closer to a rear end of the terminal receiving portion 31 toward a distal end of the terminal receiving portion 31. The connection part 362 connects distal end portions of the pair of flexible arms 361 to each other. The lock protrusion 363 is provided protrusively in a lower portion of the connection part 362.

As shown in FIG. 9, each flexible arm 361 is provided with a proximal end uprising portion 361*a* and a spring piece portion 361*b*. The proximal end uprising portion 361*a* rises up from the outside surface (upper end surface) 31*a* of an upper portion closer to the rear end of the terminal receiving portion 31. The spring piece portion 361*b* extends from a distal end of the proximal end uprising portion 361*a* toward a front end side of the terminal receiving portion 31.

A distal end side (a front end side of the connector housing 3, which is the left end side in FIG. 9) of the spring piece portion 361*b* can be deflected in a height direction (a direction of an arrow Y4 in FIGS. 2 and 9) of the connector housing 3.

In addition, as shown in FIGS. 5 and 6, the pair of flexible arms 361 are provided separately from each other in a width direction (a direction of an arrow X4 in FIG. 5) of the connector housing 3.

As shown in FIG. 6, the distal end portions of the pair of flexible arms 361 are connected to each other by the connection part 362. The distal end portions of the pair of flexible arms 361 are deflected integrally during fitting operation or unlocking operation between the connector housings.

The lock protrusion 363 of the lock arm 36 is a protrusion which protrudes toward the outside surface 31*a* of the terminal receiving portion 31 from the connection part 362 which connects the distal end portions of the pair of flexible arms 361 to each other. When fitting between the connector housings is completed, the lock protrusion 363 is engaged with a lock engagement part of the not-shown mating connector housing to thereby restrict the connector housings from moving in a detachment direction from each other. Thus, the fitting state between the connector housings is locked.

Figure 12:
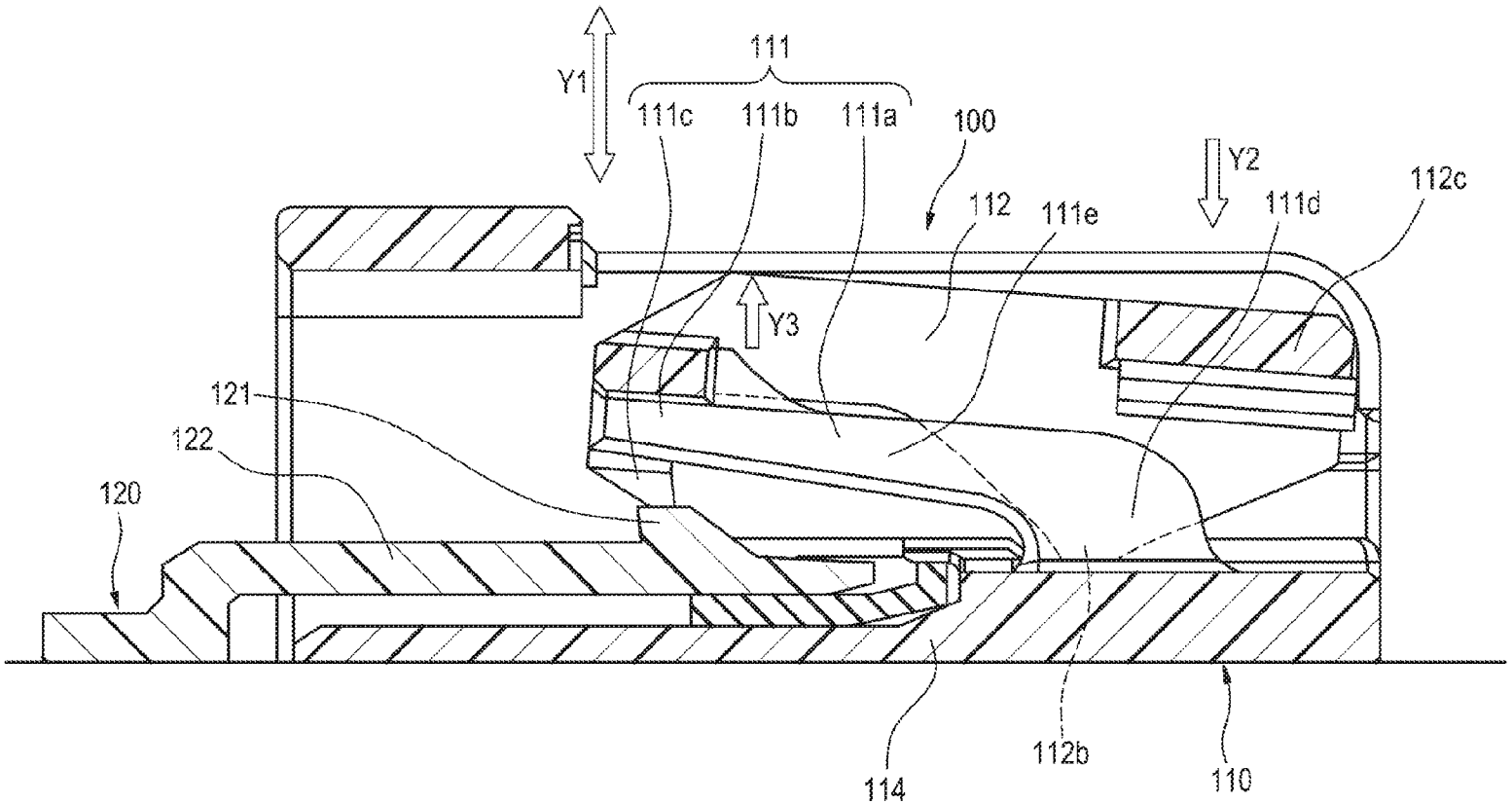
FIG. 12 PRIOR ART
FIG. 12 is a longitudinal sectional view showing a state in which the pair of connector housings connected to each other are being fitted into each other by the lock structure shown in FIG. 10.
Figure 13:
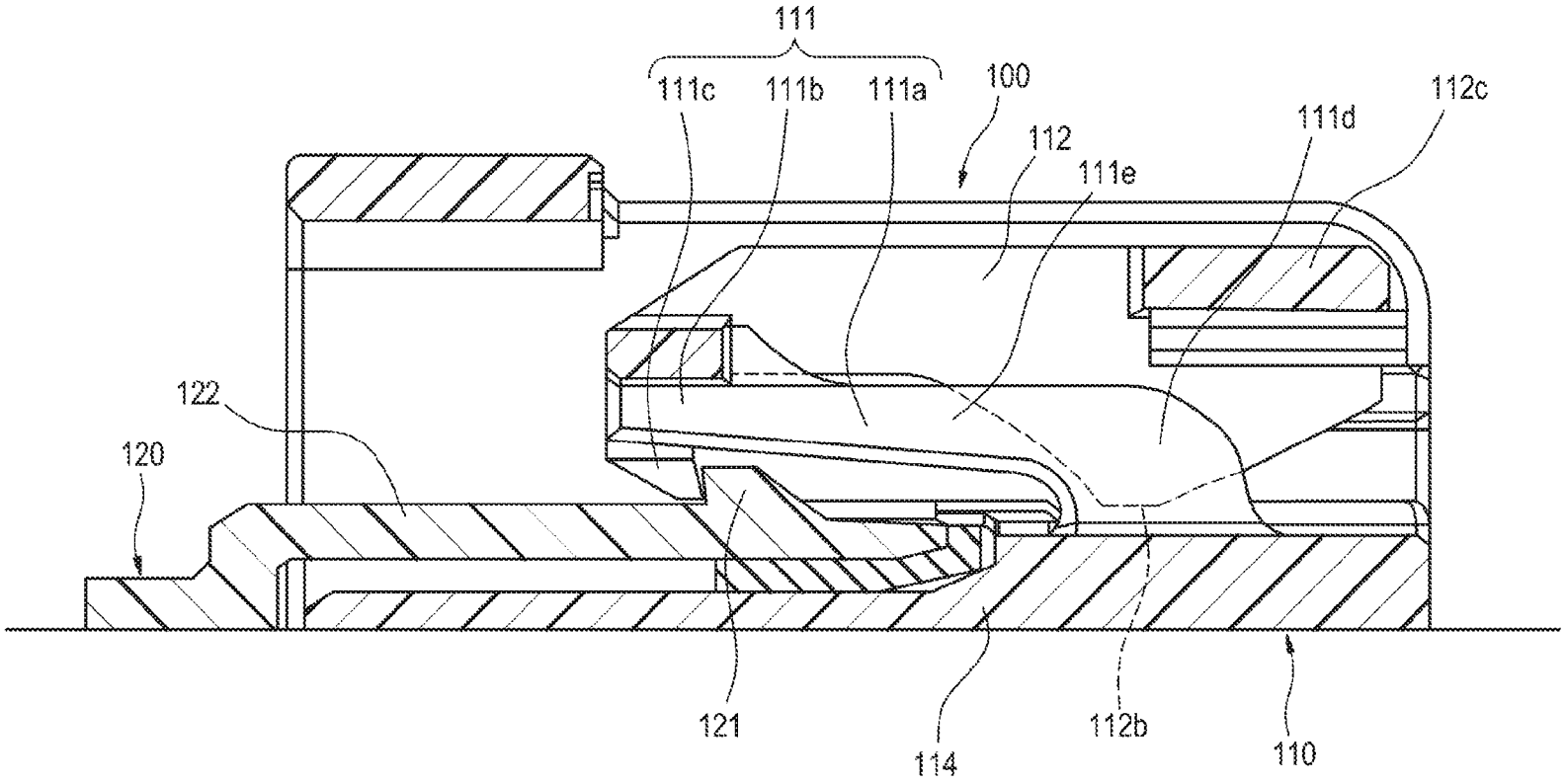
FIG. 13 PRIOR ART
FIG. 13 is a longitudinal sectional view showing a state in which fitting between the pair of connector housings shown in FIG. 12 is completed.

Incidentally, although not shown, the lock engagement part of the mating connector housing with which the lock protrusion 363 is engaged has a similar structure to the lock engagement part 121 shown in FIG. 12.

When the connector housings are being fitted into each other, the lock protrusion 363 of the lock arm 36 rides onto the lock engagement part due to elastic deformation of the flexible arms 361. In addition, when the fitting between the connector housings is completed, the lock protrusion 363 climbs over the lock engagement part to move down to the back of the lock engagement part due to elastic restoring force of the flexible arms 361. Thus, the lock protrusion 363 is engaged with the lock engagement part.

That is, when the fitting between the connector housings is completed, the lock arm 36 is engaged with the lock engagement part (not shown) on the other connector housing to thereby lock the fitting state between the connector housings.

As shown in FIGS. 4 to 6, a pair of the lock release arms 37 of the lock portion 33 are provided in positions above the lock arm 36 in the height direction of the connector housing 3.

Each of the lock release arms 37 is provided with a release arm body 371 and a fulcrum portion 372. The release arm body 371 extends from an upper portion of the connection part 362 toward the rear end side of the connector housing 3. The fulcrum portion 372 is provided in a lower portion of a longitudinally intermediate portion of the release arm body 371. That is, the lock release arms 37 are formed integrally with the lock arm 36 through the connection part 362.

The upper portion of the connection part 362 from which the lock release arms 37 extends is provided integrally with the lock release arms 37 and functions as upper portions of distal end portions of the lock release arms 37.

In addition, as shown also in FIG. 6, free ends 371*a* of the release arm bodies 371 located on the rear end side of the connector housing 3 are connected to each other by the operating portion 38.

In the case of the embodiment, the release arm bodies 371 of the pair of lock release arms 37 are disposed immediately above the pair of flexible arms 361 of the lock arm 36, as shown in FIGS. 3 and 5. In this manner, the release arm bodies 371 fall into the range of an occupied width W of the lock arm 36. That is, the lock release arms 37 fall into the range of the occupied width W of the lock arm 36 above the lock arm 36. Therefore, the width of the lock portion 33 is prevented from being larger than the width of the lock arm 36 due to the provision of the lock release arms 37.

When the operating portion 38 is pushed down in a direction of an arrow Y5 as shown in FIG. 9, of the pair of lock release arms 37, the sides of the free ends 371*a* connected to the operating portion 38 move down toward the outside surface 31*a* side of the terminal receiving portion 31.

When the fulcrum portions 372 abut against the outside surface 31*a* of the terminal receiving portion 31, the lock release arms 37 swing with the fulcrum portions 372 as fulcrums. Due to the swinging, the lock protrusion 363 is displaced in a lock release direction (a direction of an arrow Y6 in FIG. 9). The displacement of the lock protrusion 363 in the lock release direction is attended by deflection displacement of the lock arm 36 (the pair of flexible arms 361) in the lock release direction.

That is, when the operating portion 38 is pushed down to swing the lock release arms 37 around the fulcrum portions 372, the lock arm 36 can be deflected in the lock release direction. The lock state carried out by the lock arm 36 can be released by the operation of swinging the lock release arms 37 around the fulcrum portions 372.

Incidentally, the lock protrusion 363 of the lock arm 36 rides onto the not-shown lock engagement part when the connector housings are being fitted into each other. On this occasion, the lock release arms 37 provided integrally with the connection part 362 are also displaced due to the deflection displacement of the flexible arms 361. The operating portion 38 moves down toward the housing body 114 side even in such a situation.

In addition, in the case of the embodiment, as shown in FIG. 9, the upper portion of the connection part 362 displaced in the lock release direction integrally with the lock arm 36 also serves as upper surface portions of the distal end portions of the lock release arms 37. As shown in FIG. 9, the upper surface portion of the distal end portion of each lock release arm 37 is formed with a taper portion 375 in which the thickness of the lock release arm 37 is reduced gradually toward the distal end of the lock release arm 37.

In the aforementioned lock structure according to the embodiment, the lock release arms 37 are provided above the lock arm 36. Accordingly, the lock release arms 37 can be provided to fall into the occupied width W of the lock arm 36 so that the lock release arms 37 can be prevented from sticking out of lateral sides of the lock arm 36.

Therefore, the width of the lock structure (the lock portion 33) having the lock arm 36 and the lock release arms 37 can fall into the range of the width of the lock arm 36. Accordingly, it is possible to prevent the width of the lock structure from increasing due to the lock release arms 37 so that it is possible to reduce the width of the connector housing 3.

In addition, in the aforementioned lock structure according to the embodiment, when the lock release arms 37 are operated to deflect the lock arm 36 in the lock release direction in order to detach the connected connector housings from each other, the distal end sides of the lock release arms 37 move in the lock release direction (a direction of an arrow Y7 in FIG. 4) integrally with the lock arm 36.

On this occasion, the taper portion 375 in which the thickness of the lock release arm 37 is reduced gradually toward the distal end of the lock release arm 37 is provided in the upper surface portion of the distal end side of the lock release arm 37. Accordingly, it is possible to reduce the increase of the substantially protruding length of the distal end side of the lock release arm 37 in the lock release direction.

Accordingly, it is possible to suppress the increase of the occupied height of the connector housing 3 in the lock release direction so that it is possible to suppress the increase of a space required for arrangement of the connector housing 3 having the lock release arms 37. Thus, it is possible to make the arrangement of the connector housing 3 easy.

In addition, interference with peripheral equipment etc. to disturb lock release work can be prevented from occurring due to protrusions of the distal end sides of the lock release arms 37 in the lock release direction during lock release operation. Thus, it is possible to make the lock release work easy.

Incidentally, the invention is not limited to the aforementioned embodiment. Any modification, improvement, etc. can be made on the invention suitably. In addition thereto, materials, shapes, sizes, numbers, arrangement places, etc. of the respective constituent elements in the aforementioned embodiment are not limited but may be set desirably as long as they can achieve the invention.

For example, the lock arm 36 has the pair of flexible arms 316 provided separately from each other in the width direction of the connector housing 3. However, the pair of flexible arms 361 may be replaced by a single arm.

In addition, in the aforementioned embodiment, the width of the lock release arms 37 is made consistent with the width of the lock arm 36. However, the width of the lock release arms 37 may be set at a value smaller than the width of the lock arm 36.

In addition, in the aforementioned embodiment, the pair of the lock release arms 37 are provided separately from each other in the width direction of the connector housing 3. However, the lock release arms 37 may be replaced by a single arm structure.

According to an aspect of the invention, there is provided a lock structure of a connector, the lock structure including: a lock arm (36) and lock release arms (37) which are provided in one connector housing (3) of a pair of connector housings which are fitted into each other, the lock arm (36) which is engaged with a lock engagement part of the other connector housing to lock a fitting state between the connector housings when fitting between the connector housings is completed, the lock release arms (37) which is formed integrally with the lock arm (36) and which can deflect the lock arm (36) in a lock release direction, wherein the lock release arms (37) are provided above the lock arm (36).

According to the aforementioned configuration, the lock release arm is provided above the lock arm. Accordingly, the lock release arm can be provided to fall into an occupied width of the lock arm so that the lock release arm is prevented from sticking out of lateral sides of the lock arm.

Therefore, the width of the lock structure having the lock arm and the lock release arm can be made to fall into the range of the width of the lock arm. Accordingly, it is possible to prevent the width of the lock structure from increasing due to the lock release arm so that it is possible to reduce the width of the connector housing.

An upper surface portion of a distal end portion of each of the lock release arms (37) is formed with a taper portion (375) in which thickness of the lock release arm (37) is reduced gradually toward a distal end of the lock release arm (37).

According to the aforementioned configuration, when the lock release arm is operated to deflect the lock arm in the lock release direction in order to detach the connected connector housings from each other, the distal end side of the lock release arm moves in the lock release direction integrally with the lock arm. On this occasion, the upper surface portion of the distal end side of the lock release arm is provided with the taper portion in which the thickness of the lock release arm is reduced gradually toward the distal end of the lock release arm. Accordingly, it is possible to reduce the increase of the substantially protruding length of the distal end side of the lock release arm in the lock release direction.

Accordingly, it is possible to suppress the increase of an occupied height of the connector housing in the lock release direction so that it is possible to suppress the increase of a space required for arrangement of the connector housing having the lock release arm. Thus, it is possible to make the arrangement of the connector housing easy.

In addition, interference with peripheral equipment or the like to disturb lock release work can be prevented from occurring due to protrusion of the distal end side of the lock release arm in the lock release direction during lock release operation. Thus, it is possible to make the lock release work easy.

What is claimed is:

1. A lock structure of a connector, the lock structure comprising: a lock arm and a lock release arm which are provided in one connector housing of a pair of connector housings which are fitted into each other, the lock arm which is engaged with a lock engagement part of the other connector housing to lock a fitting state between the connector housings when fitting between the connector housings is completed, the lock release arm which is formed integrally with the lock arm and which can deflect the lock arm in a lock release direction, wherein the lock release arm is provided above the lock arm, and the lock release arm comprises two parallel lock release arms.

2. The lock structure according to claim 1, wherein an upper surface portion of a distal end portion of each of the lock release arms is formed with a taper portion in which thickness of the lock release arms is reduced gradually toward a distal end of the lock release arms.

3. The lock structure according to claim 1, wherein the lock arm comprises two parallel lock arms, each of which corresponds to respective one of the lock release arms.

4. A lock structure of a connector, the lock structure comprising: a lock arm and a lock release arm which are provided in one connector housing of a pair of connector housings which are fitted into each other, the lock arm which is engaged with a lock engagement part of the other connector housing to lock a fitting state between the connector housings when fitting between the connector housings is completed, the lock release arm which is formed integrally with the lock arm and which can deflect the lock arm in a lock release direction, wherein the lock release arm is disposed immediately above the lock arm, the lock arm extends forward from an outside surface of an upper portion of a rear end side of a terminal receiving portion that receives a terminal, the lock release arm extends rearward from a front end portion of the lock arm such that the lock release arm falls into a range of an occupied width of the lock arm above the lock arm, an operating portion a width of which is larger than the occupied width of the lock arm in a width direction and which extends rearward is provided integrally with an extending end portion of the lock release arm, and a pair of fulcrum portions extends downward from the lock release arm such that a portion of a rear end side of the lock arm is positioned between the pair of fulcrum portions in the width direction; and on a lower end surface of the fulcrum portions is a fulcrum which comes in contact with the outside surface of the upper portion of the terminal receiving portion when the operating portion is pressed.

5. The lock structure according to claim 4, wherein an upper surface portion of a distal end portion of the lock release arm is formed with a taper portion in which thickness of the lock release arm is reduced gradually toward a distal end of the lock release arm.

6. The lock structure according to claim 4, wherein the lock release arm comprises two parallel lock release arms, and the lock arm comprises two parallel lock arms, each of which corresponds to respective one of the lock release arms.

* * * * *